US011560706B2

(12) United States Patent
Wong et al.

(10) Patent No.: US 11,560,706 B2
(45) Date of Patent: Jan. 24, 2023

(54) MODULAR INTEGRATED BUILDING AND CONSTRUCTION METHOD THEREOF

(71) Applicant: Yau Lee Wah Construction Materials (Huizhou) Company Limited, Huizhou (CN)

(72) Inventors: Conrad Tin Cheung Wong, Shenzhen (CN); Rosana Wai Man Wong, Shenzhen (CN)

(73) Assignee: Yau Lee Wah Construction Materials (Huizhou) Company Limited, Huizhou (CN)

( * ) Notice: Subject to any disclaimer, the term of this patent is extended or adjusted under 35 U.S.C. 154(b) by 86 days.

(21) Appl. No.: 17/086,885

(22) Filed: Nov. 2, 2020

(65) Prior Publication Data

US 2021/0047824 A1 Feb. 18, 2021

Related U.S. Application Data

(62) Division of application No. 16/224,306, filed on Dec. 18, 2018, now Pat. No. 10,858,817.

(30) Foreign Application Priority Data

Sep. 25, 2018 (CN) ..... 201811114829.9

(51) Int. Cl.
*E04B 1/16* (2006.01)
*E04H 1/04* (2006.01)
(Continued)

(52) U.S. Cl.
CPC ..... *E04B 1/043* (2013.01); *E04B 1/2403* (2013.01); *E04B 1/34807* (2013.01);
(Continued)

(58) Field of Classification Search
CPC ..... E04B 1/04; E04B 1/16; E04B 1/24; E04B 1/35; E04B 1/161; E04B 1/165;
(Continued)

(56) References Cited

U.S. PATENT DOCUMENTS 3,494,092 A * 2/1970 Bottjer ..... E04B 1/04 52/236.7
3,785,095 A * 1/1974 Verner ..... E04B 1/3538 52/745.14
(Continued)

FOREIGN PATENT DOCUMENTS

KR 101678628 B1 11/2016
WO 2009112037 A1 9/2009

OTHER PUBLICATIONS

European Search Report for European Application No. 18207786.7-1005 dated May 8, 2019.

*Primary Examiner* — Phi Dieu Tran A
(74) *Attorney, Agent, or Firm* — Kim IP Law Group LLC

(57) ABSTRACT

Disclosed herewith a modular integrated building and a construction method thereof. The building comprises multiple prefabricated room units (1). A bottom of a load-bearing structure of the prefabricated room unit (1) is provided with a semi-prefabricated connecting port (2). Reinforcing bars arranged at a top of the prefabricated room unit (1) of a next floor are inserted in the connecting port (2) and thus connected with reinforcing bars arranged therein, so that the prefabricated room units (1) of two adjacent floors are connected with each other through in-situ casting concrete in the connecting port (2). A cast-in-situ concrete interlayer (3) is arranged on a top plate (11) of the prefabricated room unit (1) of a next floor, for connecting adjacent prefabricated room units (1) of a same floor together.

5 Claims, 10 Drawing Sheets

(51) Int. Cl.

| | |
|---|---|
| ***E04H 1/14*** | (2006.01) |
| ***E04B 1/04*** | (2006.01) |
| ***E04B 1/24*** | (2006.01) |
| ***E04B 1/348*** | (2006.01) |

(52) U.S. Cl.
CPC ..... *E04B 1/34823* (2013.01); *E04B 1/16* (2013.01); *E04B 2001/2445* (2013.01); *E04H 1/04* (2013.01); *E04H 1/14* (2013.01)

(58) Field of Classification Search
CPC ..... E04B 1/34807; E04B 1/3483; E04B 1/34823; E04B 1/005
See application file for complete search history.

(56) References Cited

U.S. PATENT DOCUMENTS

| | | | | |
|---|---|---|---|---|
| 3,872,635 | A * | 3/1975 | Miram | E04B 1/04 52/236.8 |
| 4,194,339 | A * | 3/1980 | Fisher | E04B 1/34823 52/79.8 |
| 4,525,975 | A * | 7/1985 | McWethy | E04B 1/34823 52/234 |
| 4,528,793 | A * | 7/1985 | Johnson | E04B 1/34823 52/745.03 |
| 4,551,961 | A | 11/1985 | Kiselewski | |
| 5,724,773 | A | 3/1998 | Hall | |
| 5,737,895 | A * | 4/1998 | Perrin | E04C 2/384 52/745.1 |
| 6,076,320 | A | 6/2000 | Butler | |
| 2014/0123573 | A1 * | 5/2014 | Farnsworth | E04B 1/3483 52/79.9 |
| 2014/0298745 | A1 | 10/2014 | Rechenmacher et al. | |

* cited by examiner

MODULAR INTEGRATED BUILDING AND CONSTRUCTION METHOD THEREOF

CROSS-REFERENCE TO RELATED APPLICATIONS

This application is a divisional of U.S. patent application Ser. No. 16/224,306, filed Dec. 18, 2018, entitled Modular Integrated Building and Construction Method Thereof, which claims priority under 35 U.S.C. § 119(a) and (b) to Chinese Patent Application No. 201811114829.9, filed Sep. 25, 2018.

FIELD OF THE INVENTION

The present invention relates to a building structure and its construction method, in particular to a building formed by prefabricated room units and a construction method thereof. The present invention can be used for multiple-story or high-rise residential or office buildings.

BACKGROUND OF THE INVENTION

Traditional residential or office buildings, in particular high-rise buildings, are built through in-situ casting concrete at the construction site. However, the construction of such traditional cast-in-situ buildings not only suffers disadvantages such as complicated construction steps, long construction period, intensive labor consumption and hardly controlled quality, but also brings about a large amount of construction rubbish and generates heavy noise and dust pollution, causing great disturbance on daily life of surrounding residents.

To this end, the construction of current buildings gradually adopts prefabricated units, such as prefabricated beams, semi-prefabricated floor slabs, or even prefabricated balconies, prefabricated bathrooms and prefabricated kitchens, and so on, to facilitate and simplify the construction procedure. This kind of construction can essentially reduce a part of on-site workload, and also shorten the construction time and reduce labor cost. However, for this kind of construction, structural members such as the shearing walls, the structural walls, the external walls, the beams, the columns or the like still have to be formed by cast-in-situ concrete structures. In addition, the wall bodies of prefabricated units, such as the prefabricated bathrooms and prefabricated kitchens, are semi-prefabricated walls, which are combined with those of adjacent prefabricated units through cast-in-situ structures. Therefore, the on-site workload is still heavy, so that the construction period cannot be further shortened.

SUMMARY OF THE INVENTION

In order to solve the above technical problem, the present invention aims to provide a modular integrated building which is formed by a plurality of prefabricated room units so that the on-site workload can be significantly reduced. In addition, the present invention further proposes a construction method for the modular integrated building.

Accordingly, the present invention proposes a modular integrated building, comprising a plurality of prefabricated room units assembled together. Each prefabricated room unit is prefabricated integrally with a top plate, a bottom plate and a wall body, with all or part of the prefabricated room units being further prefabricated integrally with a load-bearing structural wall or column. A top of each prefabricated room unit is provided with reserved, exposed reinforcing bars, and a bottom of the load-bearing structural wall or column of the prefabricated room unit is provided with a semi-prefabricated connecting port. The semi-prefabricated connecting port extends to a bottom surface and a side wall of the prefabricated room unit, and is provided with reserved, exposed reinforcing bars therein, so that reserved, exposed reinforcing bars arranged at a top of the prefabricated room unit of a next floor are inserted in the semi-prefabricated connecting port and thus connected with the reserved, exposed reinforcing bars arranged therein. The prefabricated room units of two adjacent floors are connected with each other through in-situ casting concrete in the semi-prefabricated connecting port. A cast-in-situ concrete interlayer is arranged between the bottom plate of the prefabricated room unit of a floor and the top plate of the prefabricated room unit of a next floor, for connecting adjacent prefabricated room units of a same floor together, and reinforcing bars of the cast-in-situ concrete interlayer are connected with the reserved, exposed reinforcing bars arranged at the top of the prefabricated room unit of the next floor.

An opening of the semi-prefabricated connecting port is provided on an outer side wall of the prefabricated room unit, with a teeth-shaped engaging surface formed on an inner wall of the opening.

The reserved, exposed reinforcing bars arranged in the semi-prefabricated connecting port include vertical reinforcing bars and lateral stirrups, and the reserved, exposed reinforcing bars arranged at the top of the prefabricated room unit include vertical reinforcing bars and horizontal reinforcing bars.

Concrete of the prefabricated room unit occupies at least 80% of concrete of the whole building by volume.

The prefabricated room unit is embedded therein with water pipelines and electrical conduits, and has a decoration layer on its surface.

The prefabricated room unit is provided at an edge of its top with a rim extending upwardly.

A vertical sealing strip is arranged between two adjacent prefabricated room units of a same floor, and a horizontal sealing strip is arranged between two prefabricated room units of adjacent floors.

Between the bottom plate of the prefabricated room unit of a floor and the top plate of the prefabricated room unit of a next floor are arranged a plurality of bearing plates, and a cement mortar layer having a same height as the load-bearing plates.

The top plate of the prefabricated room unit has a thickness in a range of 60-90 mm, the bottom plate has a thickness in a range of 60-90 mm, and the cast-in-situ concrete interlayer has a thickness in a range of 90-140 mm.

The present invention further proposes a construction method for the modular integrated building, comprising: step A, mounting the prefabricated room unit including the load-bearing structural wall or column on the top of the lower structure of the building that has been formed, so that the reserved, exposed reinforcing bars arranged at the top of the lower structure of the building are inserted into the semi-prefabricated connecting port arranged at the bottom of the prefabricated room unit; step B, binding the reserved, exposed reinforcing bars in the semi-prefabricated connecting port with the reserved, exposed reinforcing bars arranged at the top of the lower structure of the building; step C, establishing a template at the semi-prefabricated connecting port and pouring concrete; step D, binding reinforcing bars at the top of the prefabricated room unit, and connect them with the reserved, exposed reinforcing bars arranged at the top of the prefabricated room unit; and step E, pouring concrete at the top of the prefabricated room unit with which reinforcing bars have been bound.

Prior to step D, the prefabricated room unit with no load-bearing structural wall or column is mounted on the top of the lower structure of the building.

Prior to mounting the prefabricated room unit, a plurality of bearing plates is placed on the top of the lower structure of the building and a cement mortar layer is provided.

Before the prefabricated room unit is mounted, a horizontal sealing strip is arranged on the top of the prefabricated room unit of an upper floor, and when the prefabricated room unit is mounted, a vertical sealing strip is arranged between two adjacent prefabricated room units of a same floor.

Prior to step D, vertical supporting columns are mounted in the prefabricated room unit of a current floor, for supporting the top plate of said prefabricated room unit.

According to the modular integrated building and its construction method of the present invention, two adjacent prefabricated room units along the vertical direction are connected with each other through connecting the reserved, exposed reinforcing bars associated with said two adjacent prefabricated room units in the semi-prefabricated connecting port and then pouring concrete therein, and two adjacent prefabricated room units of the same floor are connected with each other through a cast-in-situ concrete interlayer between said two adjacent prefabricated room units along the vertical direction, compared with the prior arts. In addition, the prefabricated room unit is provided integrally with the top plate, bottom plate, wall body and load-bearing wall or column, so that the construction is more convenient and rapid, and the on-site workload can be significantly reduced with a controllable quality. In the meantime, the central region and the side region of the building can be constructed in parallel, so that the construction period can be shortened significantly, even achieving a 33%-reduction. Moreover, the labor cost is reduced, and the disturbance of the construction on surrounding residents can be avoided to the maximum extent.

DETAILED DESCRIPTION OF THE EMBODIMENTS

In the following, the embodiments of the present invention will be further illustrated with reference to the drawings.

Figure 12:
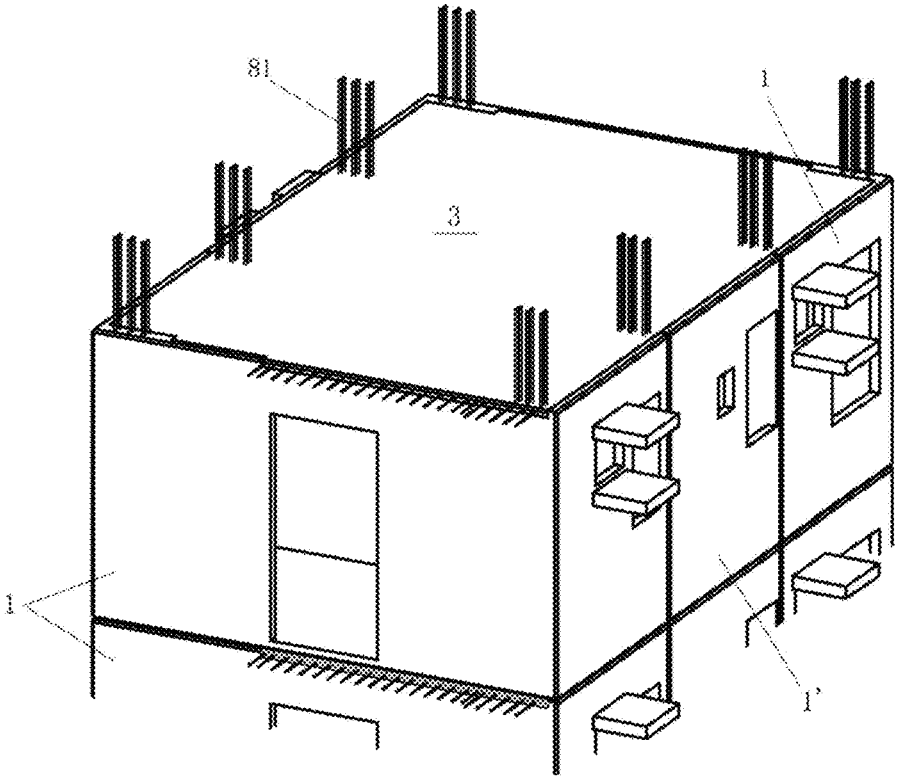
FIG. 12 schematically shows step 11 of the construction method for modular integrated building according to the present invention.
Figure 16:
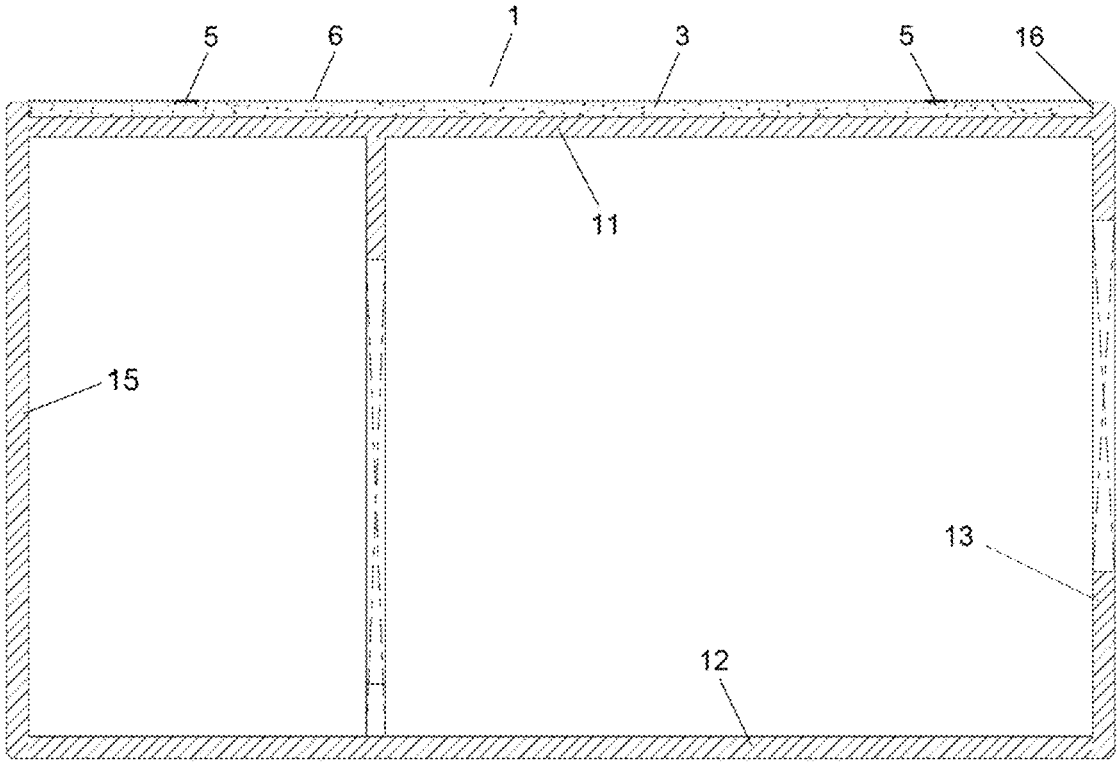
FIG. 16 is a cross-sectional view of the prefabricated room unit along the vertical direction.

As shown in FIG. 12, a modular integrated building according to the present invention is formed by assembling a plurality of prefabricated room units 1 together. The prefabricated room unit 1 can be a kitchen, a bathroom, a sitting room, a dining room, a bedroom, a storage room, or the like. As shown in FIG. 16, the prefabricated room unit 1 as a whole is prefabricated at a factory, integrally with a top plate 11, a bottom plate 12, a wall body 13, or the like. According to the requirement on structural design, the prefabricated room unit 1 can be further integrated with a load-bearing structural wall or column 15, and structural members such as a door, a window, or the like. The prefabricated room unit 1 can be further embedded in advance with electrical conduits, water pipelines, or the like. The prefabricated room unit 1 is provided with reserved, exposed reinforcing bars at its top, and with a semi-prefabricated connecting port 2 at the bottom of the load-bearing structural wall or column 15.

Figure 4:
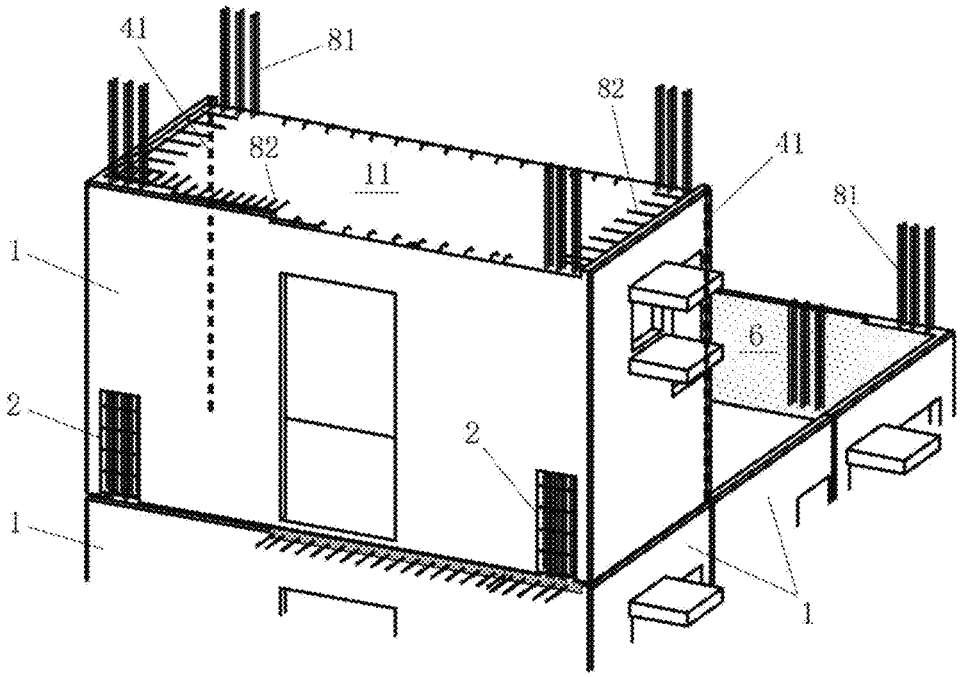
FIG. 4 schematically shows step 4 of the construction method for modular integrated building according to the present invention.
Figure 13:
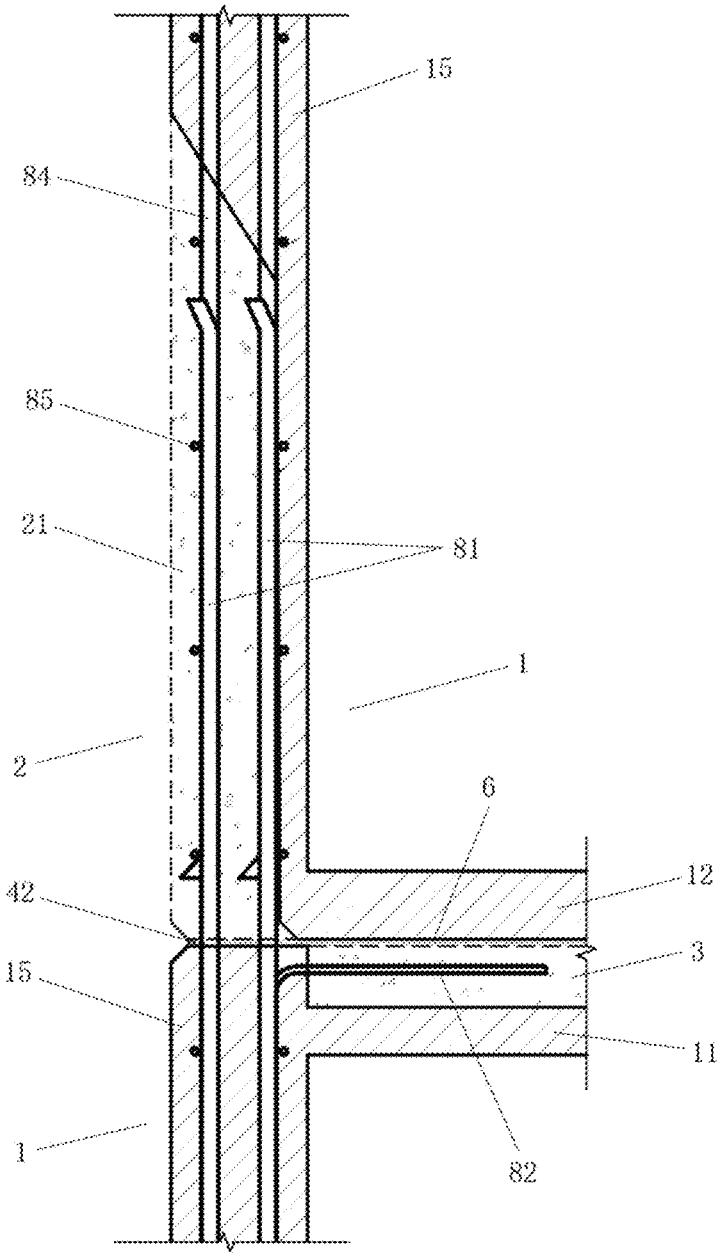
FIG. 13 is a cross-sectional view at a region of a semi-prefabricated connecting port along a vertical direction.
Figure 14:
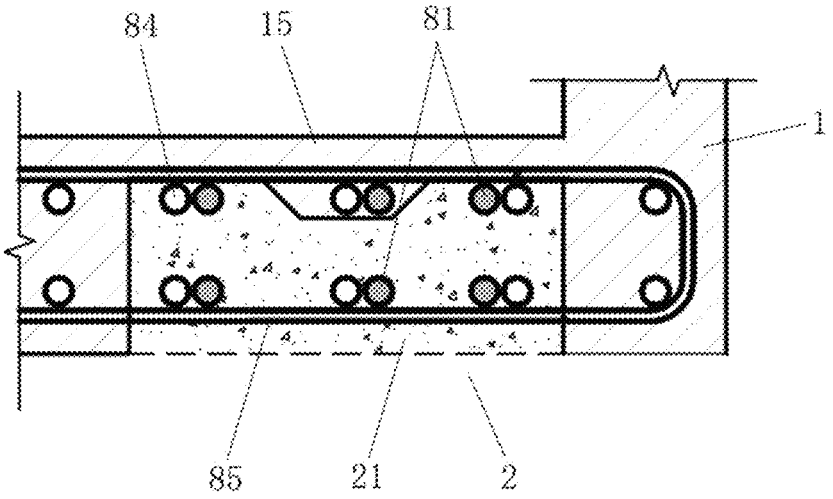
FIG. 14 is a cross-sectional view at the region of the semi-prefabricated connecting port along a longitudinal direction.

As shown in FIG. 4, the reserved, exposed reinforcing bars arranged at the top of the prefabricated room unit 1 include vertical reinforcing bars 81 and horizontal reinforcing bars 82. As shown in FIGS. 13 and 14, the semi-prefabricated connecting port 2 extends to a bottom surface of the prefabricated room unit 1, and opens to a side wall thereof. The semi-prefabricated connecting port 2 is also provided with reserved, exposed reinforcing bars therein, including vertical reinforcing bars 84 and lateral stirrups 85. At the construction site for the building, the vertical reinforcing bars 81 arranged at the top of the prefabricated room unit 1 of a next floor are inserted into the semi-prefabricated connecting port 2, so as to be bound with the vertical reinforcing bars 84 and lateral stirrups 85 arranged in the semi-prefabricated connecting port 2. After a template is established at the semi-prefabricated connecting port 2, the prefabricated room units 1 of two adjacent floors can be connected with each other through in-situ casting concrete 21 in the semi-prefabricated connecting port 2.

In order to avoid damage of indoor decoration due to indoor concrete pouring, facilitate the completion of the indoor decoration at the factory totally, increase the whole prefabrication percentage, and avoid disconnection between the floor and the wall of the prefabricated room unit due to inner wall opening which would negatively influence on the production and transportation, the semi-prefabricated connecting port 2 is configured to open to an outer side wall of the prefabricated room unit 1. In addition, in order to increase the bonding force between the prefabricated concrete and the cast-in-situ concrete 21, the semi-prefabricated connecting port 2 is provided with a teeth-shaped engaging surface on an inner wall thereof. Preferably, the inner wall of the semi-prefabricated connecting port 2 is configured to be an inclined surface, thus increasing the contact area between the prefabricated concrete and the cast-in-situ concrete 21 so that the bonding force therebetween can be further improved.

Figure 11:
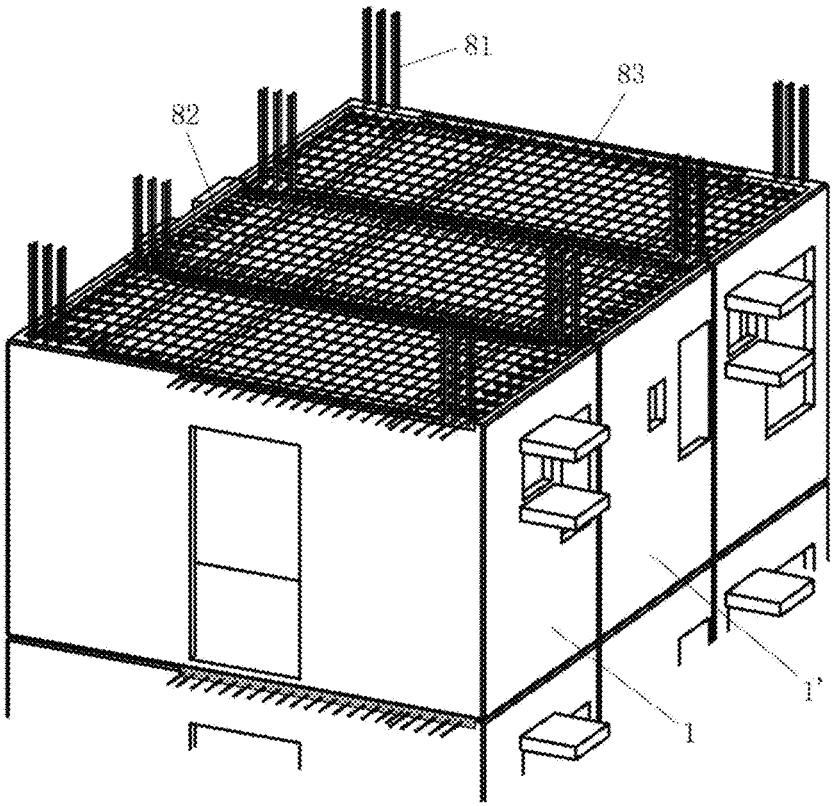
FIG. 11 schematically shows step 10 of the construction method for modular integrated building according to the present invention.

As shown in FIGS. 11, 13, and 16, a cast-in-situ concrete interlayer 3 is arranged between the bottom plate 12 of the prefabricated room unit 1 of a floor and the top plate 11 of the prefabricated room unit 1 of a next floor, so as to connect adjacent prefabricated room units 1 of the same floor together. Reinforcing bars 10, which are arranged on-site in the cast-in-situ concrete interlayer 3, are bound with the reserved, exposed reinforcing bars, such as the horizontal reinforcing bars 82, arranged at the top of the prefabricated room unit 1 of the next floor.

The prefabricated room unit 1 is provided at an edge of its top with a rim 16 extending upwardly, which can facilitate the in-situ casting of concrete at the top of the prefabricated room unit 1. In this embodiment, the rim 16 has a height equal to a thickness of the cast-in-situ concrete interlayer 3.

As shown in FIG. 16, several load-bearing plates 5 and a cement mortar layer 6 are arranged between the bottom plate 12 of the prefabricated room unit 1 of a floor and the top of the prefabricated room unit 1 of a next floor. The load-bearing plate 5, which can be formed by a metal gasket pad, is used to support the prefabricated room unit 1. The cement mortar layer 6, having a thickness equal to a height of the load-bearing plate 5, is used to fill up the top of the prefabricated room unit 1 so that the top has a flat surface.

According to the span size of the prefabricated room unit 1, the top plate 11 of the prefabricated room unit 1 has a thickness in a range of 60-90 mm, the bottom plate 12 has a thickness in a range of 60-90 mm, and the cast-in-situ concrete interlayer 3 has a thickness in a range of 90-140 mm. In the present embodiment, the top plate 11 has a thickness of 70 mm, the bottom plate 12 has a thickness of 70 mm, the cast-in-situ concrete interlayer 3 has a thickness of 125 mm, and the cement mortar layer 6 has a thickness of 10 mm.

Figure 15:
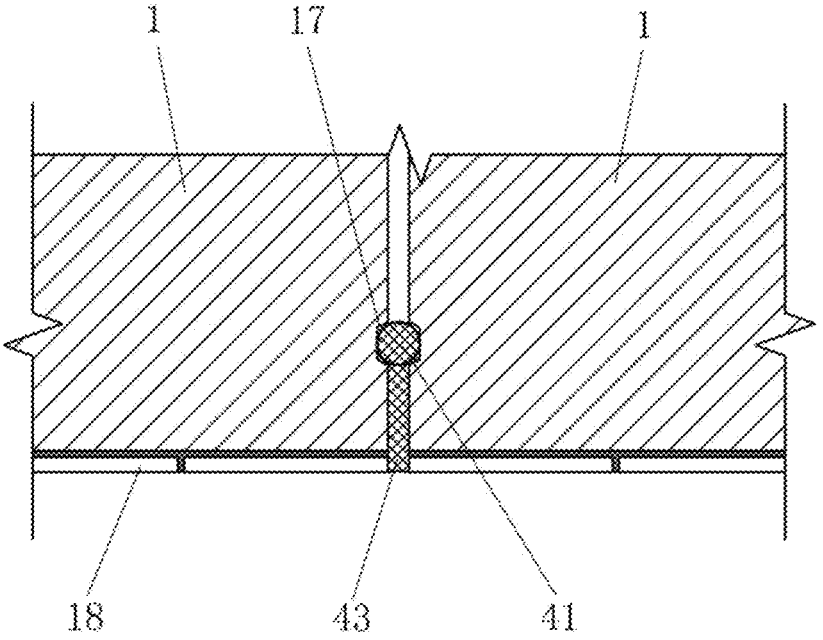
FIG. 15 schematically shows a connection between two adjacent prefabricated room units of a same floor.

As shown in FIG. 15, a vertical sealing strip 41 is arranged between two adjacent prefabricated room units 1 of a same floor, and used to seal a joint between said two adjacent prefabricated room units 1, so as to prevent rain from penetrating into the joint. The vertical sealing strip 41 is located at an outermost position adjacent to the prefabricated room unit 1. In this position, the outer wall surface of the prefabricated room unit 1 can be provided with a vertical recess 17 for receiving the vertical sealing strip 41. The outer surface 18 of the prefabricated room unit 1 can be decorated at the factory in advance, which can be formed as a bare concrete surface, a painting surface, or a tile-stuck surface.

As shown in FIG. 13, a horizontal sealing strip 42 is arranged between two adjacent prefabricated room units 1 along the vertical direction. The horizontal sealing strip 42 mainly seals the load-bearing structure, and consists of two strips, so that concrete can be prevented from outward leakage when it is poured into the semi-prefabricated connecting port 2. The vertical sealing strip 41 and the horizontal sealing strip 42 as mentioned above can be made of rubber, plastics, or the like.

The modular integrated building according to the present invention has a prefabrication percentage of over 80%. That means, the concrete of the prefabricated room units 1 occupies over 80% of concrete of the whole building by volume, which is significantly higher than current building structures. In addition, in order to further reduce the on-site workload, the prefabricated room unit 1 can be further provided with decorating surface layers. 90% of the decoration can be completed at the factory. The indoor decoration can include the following. For sitting room, dining room and bed room, plaster can be performed in advance, and thus only rendering and painting steps are necessary to be performed on-site. In addition, tiles and skirting lines are laid on the floor thereof. For kitchen, tiles are laid on the wall and the floor thereof, and cabinets, wash basins, gas stoves and related pipelines are mounted. For bathroom, tiles are laid on the wall and the floor thereof, and bathtubs, toilets, hand basins, soap boxes, mirror cabinets and related pipelines are mounted. Moreover, the decoration for door sills, door frames, aluminum windows, glasses, and external wall surfaces can be all performed at the factory.

The construction method for the modular integrated building according to the present invention includes the following steps.

Figure 1:
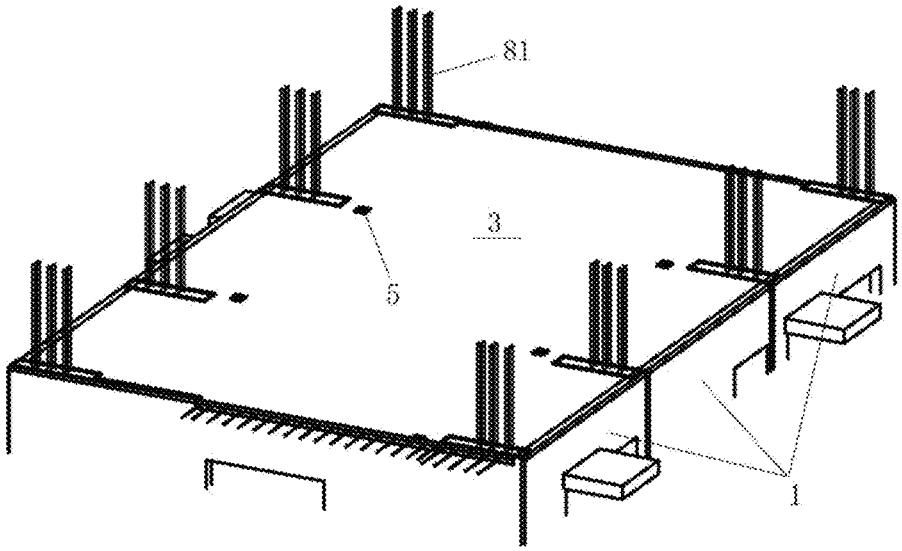
FIG. 1 schematically shows step 1 of a construction method for modular integrated building according to the present invention.

In step 1, as shown in FIG. 1, after a lower-floor structure of the building reaches sufficient strength, load-bearing plates 5 are placed at designated positions on the top of the lower-floor structure of the building. These load-bearing plates 5 are used to support the prefabricated room unit 1 to be installed.

Figure 2:
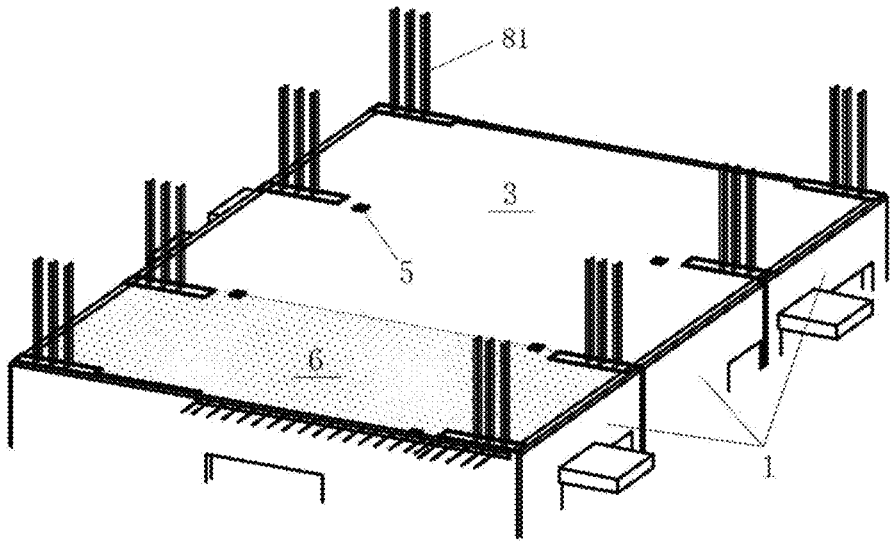
FIG. 2 schematically shows step 2 of the construction method for modular integrated building according to the present invention.

In step 2, as shown in FIG. 2, a cement mortar layer 6 is formed by laying sufficient amount of cement mortar at positions of the prefabricated room unit 1 to be installed, except the load-bearing structural wall or column 15.

Figure 3:
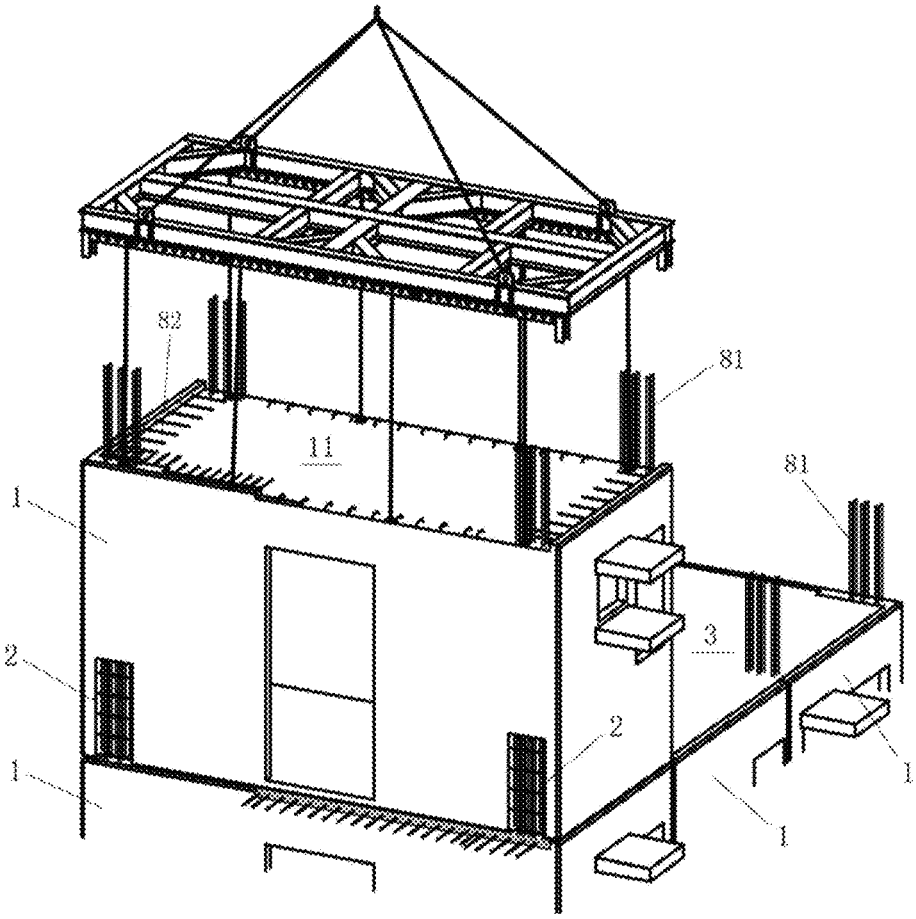
FIG. 3 schematically shows step 3 of the construction method for modular integrated building according to the present invention.

In step 3, as shown in FIG. 3, after the horizontal sealing strip is placed at its designated position, the prefabricated room unit 1 including the load-bearing structural wall or column 15 is hoisted to its designed position on the top of the lower-floor structure of the building, so that the vertical reinforcing bars 81 reserved at the top of the lower-floor structure of the building are inserted into the semi-prefabricated connecting port 2 located at the bottom of the prefabricated room unit 1.

In step 4, as shown in FIG. 4, the vertical sealing strip 41 is mounted on a surface of the prefabricated room unit 1 facing the adjacent prefabricated room unit of the same floor.

Figure 5:
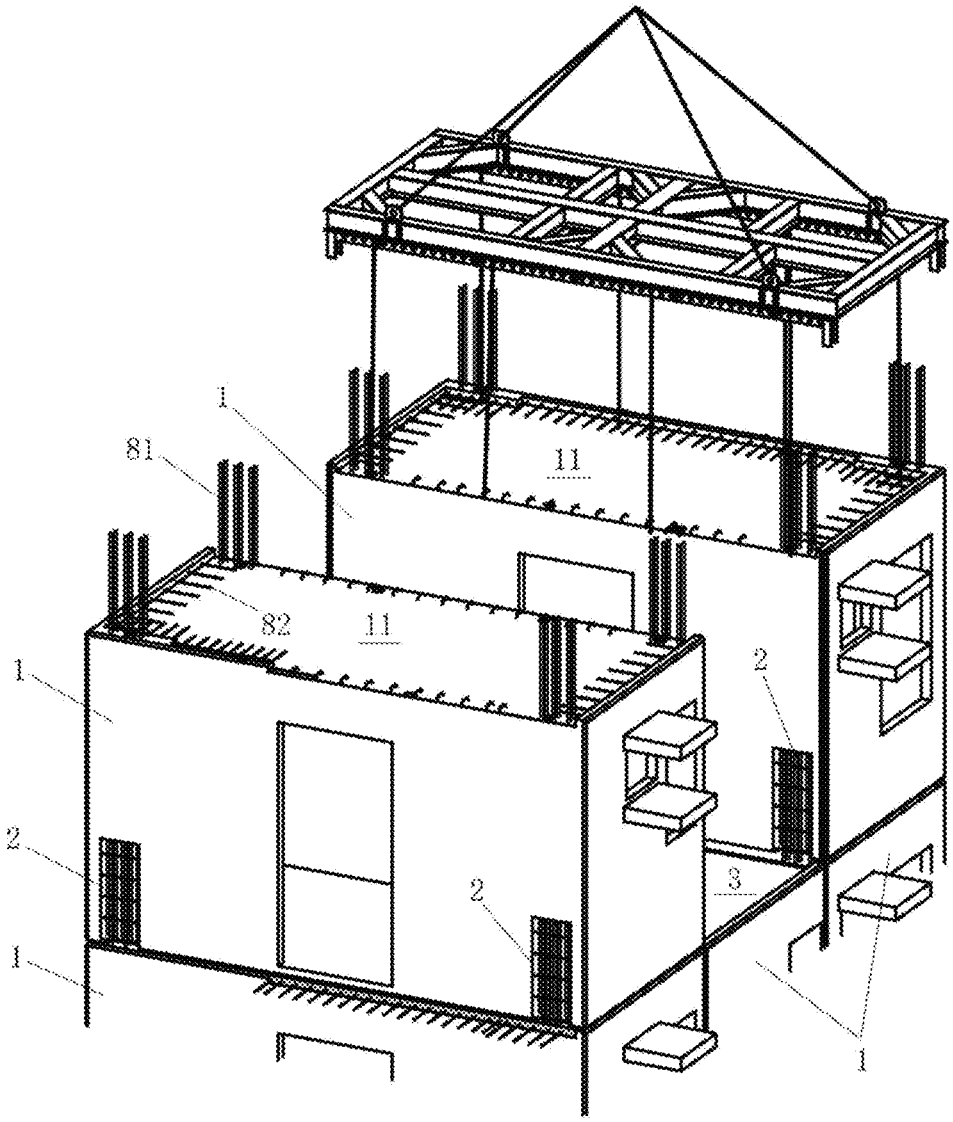
FIG. 5 schematically shows step 5 of the construction method for modular integrated building according to the present invention.

In step 5, as shown in FIGS. 4 and 5, steps 2 to 4 are repeated so that a next prefabricated room unit 1 is hoisted to its designed position.

Figure 6:
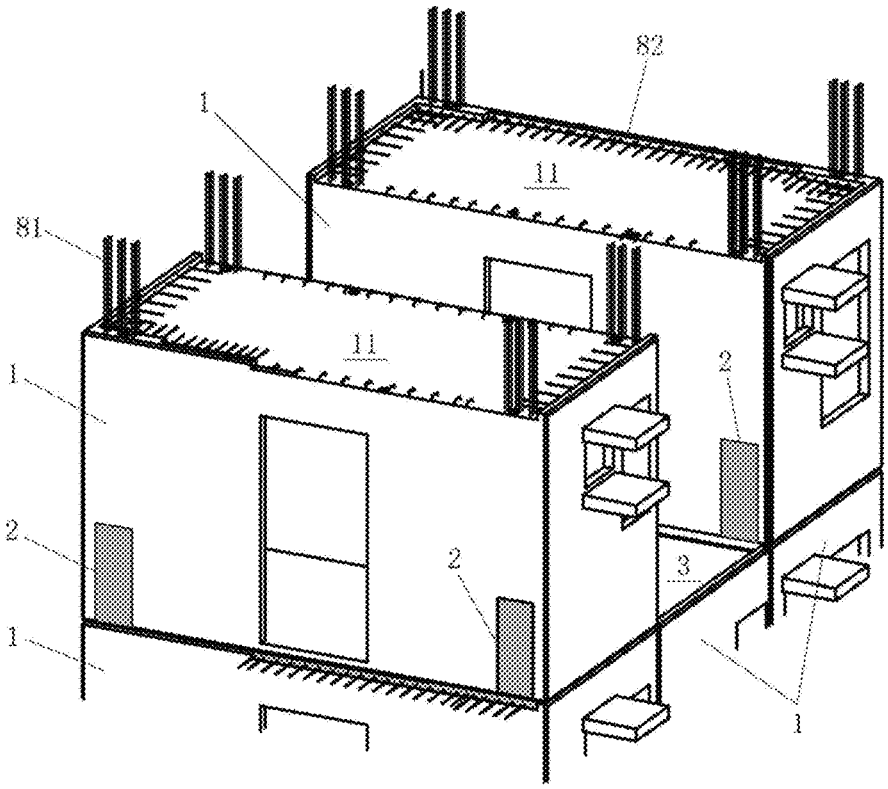
FIG. 6 schematically shows step 6 of the construction method for modular integrated building according to the present invention.

In step 6, as shown in FIG. 6, the reserved, exposed reinforcing bars (including the vertical reinforcing bars 84 and the lateral stirrups 85) in the semi-prefabricated connecting port 2 located at the bottom of the prefabricated room unit 1 are bound with the vertical reinforcing bars 81 reserved at the top of the lower-floor structure of the building, and concrete is cast after a template is established at the semi-prefabricated connecting port 2, wherein the template is removed after the cast-in-situ concrete reaches sufficient strength.

Figure 7:
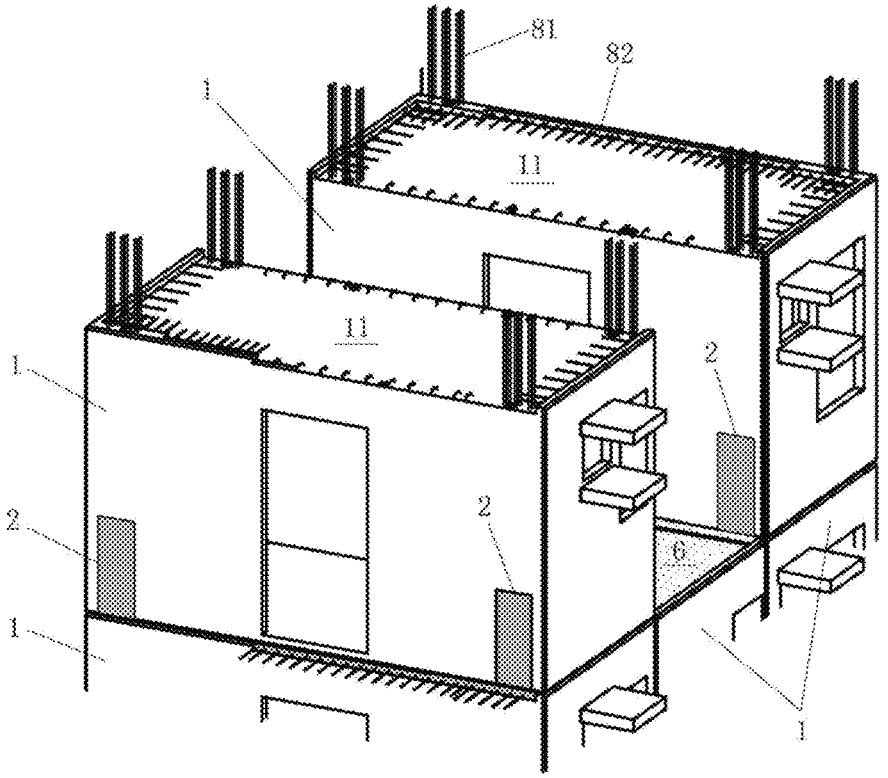
FIG. 7 schematically shows step 7 of the construction method for modular integrated building according to the present invention.

In step 7, as shown in FIG. 7, a cement mortar layer 6 is formed by laying sufficient amount of cement mortar on the top of the lower-floor structure of the building at positions where the prefabricated room unit 1' including no load-bearing structural wall or column 15 will be mounted.

Figure 8:
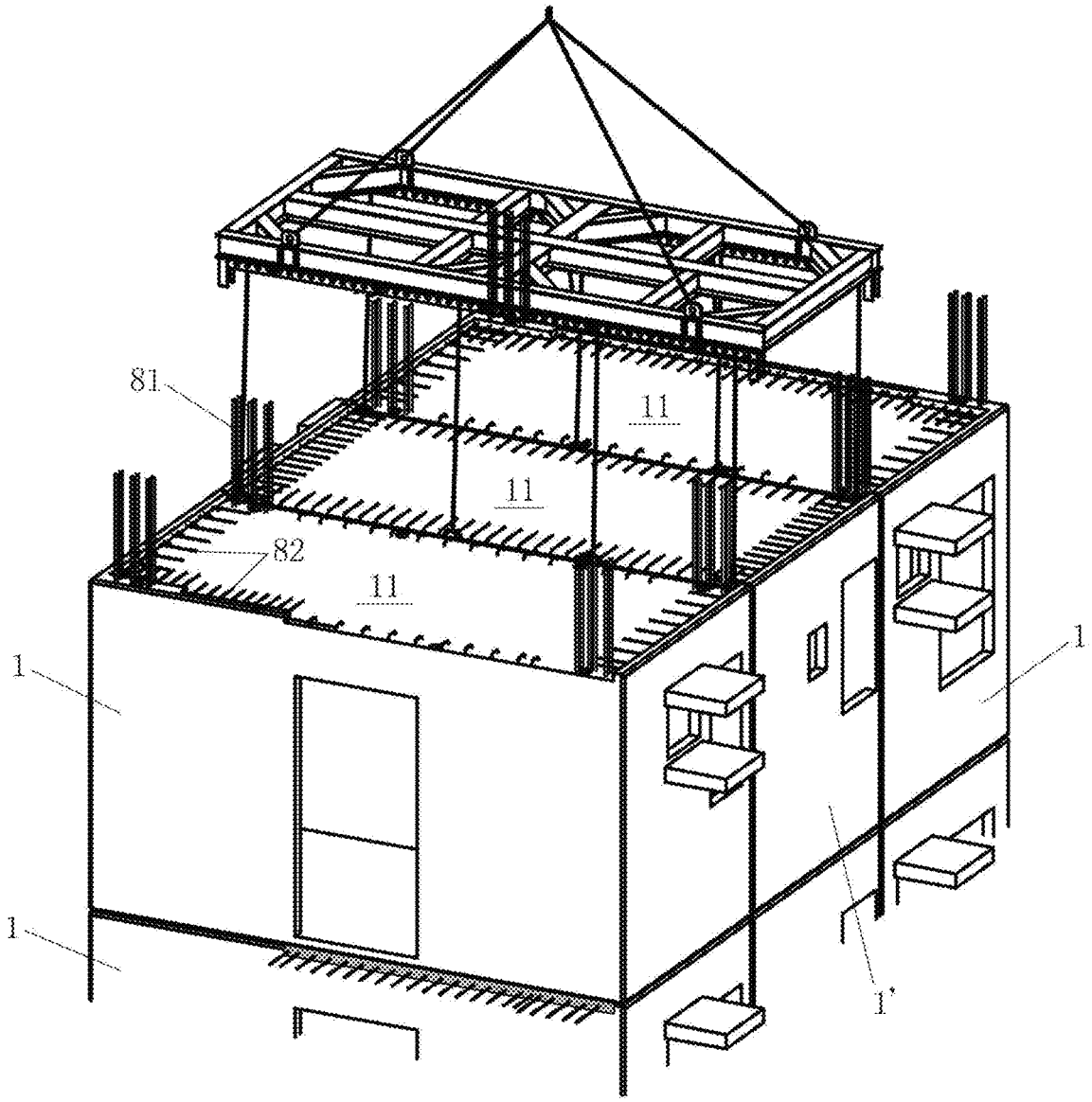
FIG. 8 schematically shows step 8 of the construction method for modular integrated building according to the present invention.

In step 8, as shown in FIG. 8, the prefabricated room unit 1' including no load-bearing structural wall or column 15 is hoisted to its designed position on the top of the lower-floor structure of the building.

Figure 9:
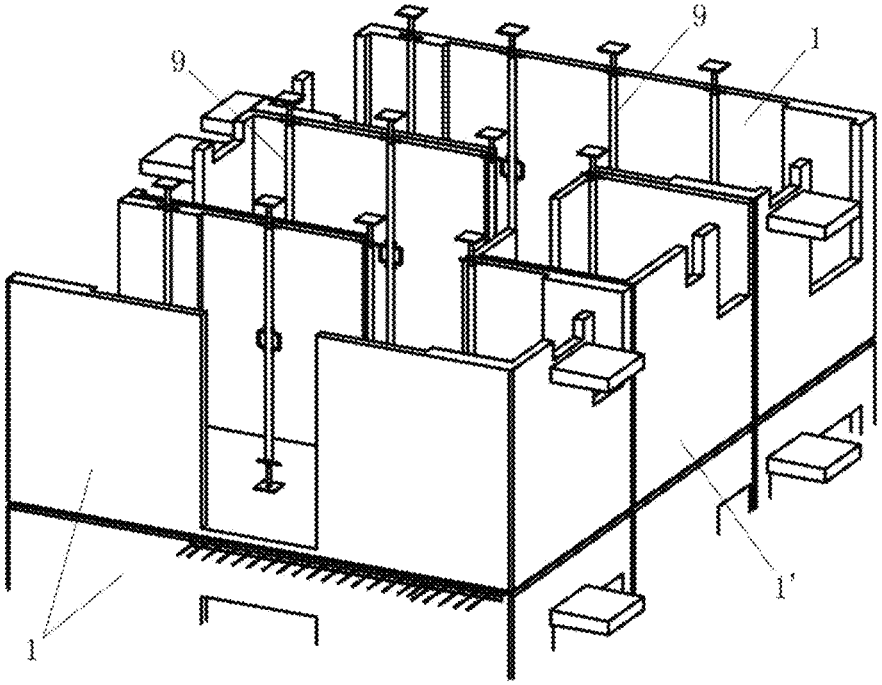
FIG. 9 schematically shows a first example of step 9 of the construction method for modular integrated building according to the present invention.
Figure 10:
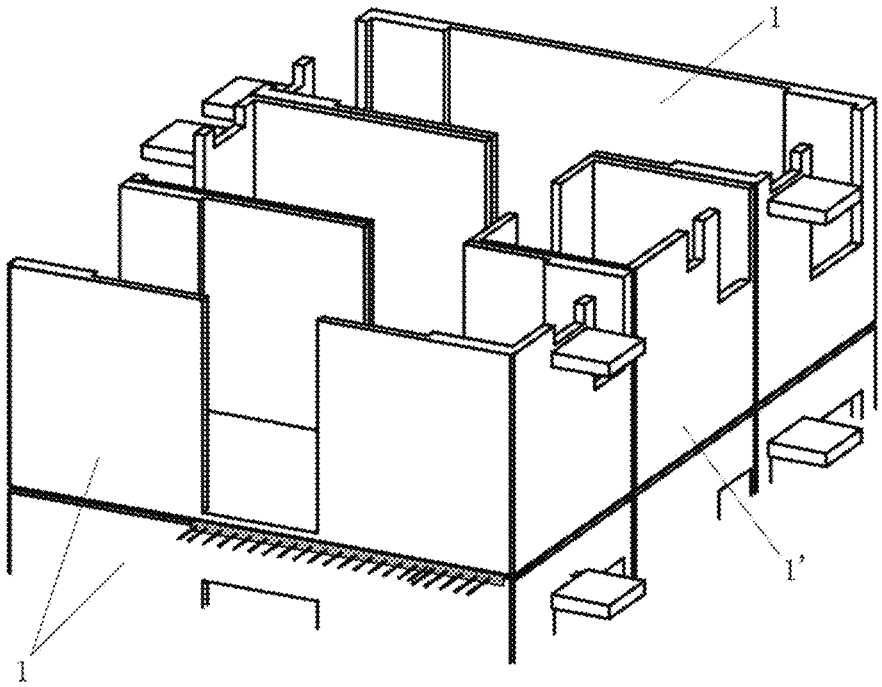
FIG. 10 schematically shows a second example of step 9 of the construction method for modular integrated building according to the present invention.

In step 9, as shown in FIG. 9, several vertical supporting columns 9 are mounted in the prefabricated room unit 1 on the current floor if necessary, so as to support the top plate 11 of the prefabricated room unit 1. However, this is suitable only for the situation requiring no indoor decoration. If indoor decoration is desirable, no supporting columns 9 are mounted in the prefabricated room unit 1 on the current floor, as shown in FIG. 10.

In step 10, as shown in FIG. 11, reinforcing bars 83 are bound at the top of the prefabricated room unit 1 on the current floor, and connected with the reserved, exposed reinforcing bars 8, such as the horizontal reinforcing bars 82, arranged at the top of the prefabricated room unit 1. Moreover, water pipelines, electrical conduits, lamp boxes, and other embedded components are fixed through the reinforcing bars.

In step 11, as shown in FIG. 12, concrete is poured in-situ at the top of the prefabricated room unit 1 in which reinforcing bars are bound, so as to form the cast-in-situ concrete interlayer 3.

Another floor of the building can be completed through repeating the above steps 1 to 11.

It can be seen that the modular integrated building according to the present invention has a very high prefabrication percentage. Most of the decoration can be completed at the factory, and in the meantime the central region and the side region of the building can be constructed in parallel. Therefore, the construction period for a standard floor can be shortened to four days, compared to six days for which only part of prefabricated members are used currently. Thus it means a 33%-reduction for the construction period. Moreover, the construction is more convenient and rapid, and the on-site workload can be significantly reduced with a controllable quality. Furthermore, the labor cost is reduced, and the disturbance of the construction on surrounding residents can be avoided to the maximum extent.

The foregoing description is merely illustrative of preferred embodiments of the present invention, and is not intended to limit the present invention. Various changes and modifications may be made by those skilled in the art. Any modifications, equivalent substitutions, improvements, and the like within the spirit and principles of the present invention are intended to be included within the scope of the present invention.

The invention claimed is:

1. A construction method for a modular integrated building; comprising:

mounting a prefabricated room unit including a load-bearing structural wall or column on a top of a lower structure of the building that has been formed, so that reserved, exposed reinforcing bars arranged at the top of a lower structure of the building are inserted into a semi-prefabricated connecting port arranged at a bottom of the prefabricated room unit of a modular integrated building;

binding reserved, exposed reinforcing bars in the semi-prefabricated connecting port with the reserved, exposed reinforcing bars arranged at the top of the lower structure of the building;

establishing a template at the semi-prefabricated connecting port and pouring concrete;

binding reinforcing bars at a top of the prefabricated room unit, and connecting them with reserved, exposed reinforcing bars arranged at the top of the prefabricated room unit; and pouring concrete at the top of the prefabricated room unit with which reinforcing bars have been bound to form a cast-in-situ concrete interlayer, wherein the modular integrated building comprises:

a plurality of the prefabricated room units assembled together, each prefabricated room unit being prefabricated integrally with a top plate, a bottom plate and a wall body, with all or part of the prefabricated room units being further prefabricated integrally with the load-bearing structural wall or column, wherein the top of each prefabricated room unit is provided with the reserved, exposed reinforcing bars, and a bottom of the load-bearing structural wall or column of the prefabricated room unit is provided with the semi-prefabricated connecting port;

wherein the semi-prefabricated connecting port extends to a bottom surface and a side wall of the prefabricated room unit, and is provided with the reserved, exposed reinforcing bars therein, so that reserved, exposed reinforcing bars arranged at a top of the prefabricated room unit of a next floor are inserted in the semi-prefabricated connecting port and thus connected with the reserved, exposed reinforcing bars arranged therein, the prefabricated room units of two adjacent floors being connected with each other through in-situ casting concrete in the semi-prefabricated connecting port; and wherein the cast-in-situ concrete interlayer is arranged between the bottom plate of the prefabricated room unit of a floor and the top plate of the prefabricated room unit of a next floor, for connecting adjacent prefabricated room units of a same floor together, and reinforcing bars of the cast-in-situ concrete interlayer are connected with the reserved, exposed reinforcing bars arranged at the top of the prefabricated room unit of the next floor.

2. The construction method for a modular integrated building according to claim 1, wherein prior to the binding reinforcing bars step a prefabricated room unit with no load-bearing structural wall or column is mounted on the top of the lower structure of the building.

3. The construction method for a modular integrated building according to claim 1, wherein prior to the mounting the prefabricated room unit step, a plurality of bearing plates is placed on the top of the lower structure of the building and a cement mortar layer is provided.

4. The construction method for a modular integrated building according to claim 1, wherein prior to the mounting the prefabricated room unit step, a horizontal sealing strip is arranged on the top of a prefabricated room unit of an upper floor, and when the prefabricated room unit is mounted, a vertical sealing strip is arranged between two adjacent prefabricated room units of a same floor.

5. The construction method for a modular integrated building according to claim 1, wherein prior to the binding reinforcing bars step, vertical supporting columns are mounted in the prefabricated room unit of a current floor, for supporting a top plate of said prefabricated room unit.

* * * * *